US005224694A

United States Patent [19]

Magee

[11] Patent Number: 5,224,694

[45] Date of Patent: Jul. 6, 1993

[54] SELECTIVELY DISABLED SIGNATURE FEEDING APPARATUS

[75] Inventor: Lawrence D. Magee, Bolingbrook, Ill.

[73] Assignee: R. R. Donnelley & Sons Co., Lisle, Ill.

[21] Appl. No.: 842,255

[22] Filed: Feb. 27, 1992

[51] Int. Cl.[5] ..... B65H 3/12

[52] U.S. Cl. ..... 271/95; 271/96; 271/100; 271/102; 271/107; 271/108; 221/153

[58] Field of Search ..... 271/11, 20, 93, 94, 271/95, 96, 99, 100, 102, 108, 107; 221/151, 152, 153

[56] References Cited

U.S. PATENT DOCUMENTS

| | | | |
|---|---|---|---|
| 3,831,930 | 8/1974 | Shimizu | 271/95 X |
| 3,836,139 | 9/1974 | Shimizu | 271/95 |
| 3,929,257 | 12/1975 | Mohan | 221/152 |
| 4,000,800 | 1/1977 | Loucks, Sr. | 271/152 X |
| 4,350.466 | 9/1982 | Bahr et al. | 271/95 X |
| 4,596,545 | 6/1986 | Greenwell | 271/95 X |
| 4,735,600 | 4/1988 | Drenke et al. | 271/95 X |
| 4,740,129 | 4/1988 | Sponseller | 271/95 X |
| 4,881,934 | 11/1989 | Harston et al. | 271/95 X |
| 5,028,044 | 7/1991 | Fischer | 271/95 X |
| 5,029,834 | 7/1991 | Boldrini et al. | 271/96 X |
| 5,054,761 | 10/1991 | Dietrich et al. | 271/95 |
| 5,061,231 | 10/1991 | Dietrich et al. | 271/95 X |
| 5,062,545 | 11/1991 | Takamura et al. | 221/153 X |

FOREIGN PATENT DOCUMENTS 1124754 3/1962 Fed. Rep. of Germany ..... 271/152

*Primary Examiner*—H. Grant Skaggs
*Assistant Examiner*—Carol Lynn Druzbick
*Attorney, Agent, or Firm*—Wood, Phillips, Van Santen, Hoffman & Ertel

[57] ABSTRACT

In order to avoid disruption of a stack of signatures, particularly when a cyclically operable signature feeding apparatus is temporarily disabled, the utilization of a unique latch arrangement is contemplated. The feeding apparatus will generally include a driven rotary drum having a plurality of signature grippers disposed about the periphery thereof. The signature grippers are adapted to grip signatures seriatim upon receipt from a signature supply hopper. A suction assembly is driven by a cam for shifting signatures seriatim from the signature supply hopper to the rotary drum for gripping by the signature grippers. The suction assembly includes oscillating suction grippers together with a vacuum control valve. The signature feeding apparatus further includes a cam follower operatively associated with the suction assembly to control movement of the oscillating suction grippers and operation of the vacuum control valve. With this arrangement, a latch is provided for latching the cam follower in a position out of the full path of movement of the cam to selectively disable the operating suction grippers and the vacuum control valve.

14 Claims, 2 Drawing Sheets

SELECTIVELY DISABLED SIGNATURE FEEDING APPARATUS

FIELD OF THE INVENTION

The present invention is generally directed to a device generally known as a signature feeding apparatus and, more particularly, a signature feeding apparatus in which the suction grippers and the vacuum valve are selectively disabled.

BACKGROUND OF THE INVENTION

Many large circulation periodicals are gathered on a binding line for stitching, trimming, bundling, and shipping. The binding line typically may include a plurality of signature feeding apparatus, each of which may have a driven rotary drum with a plurality of signature grippers disposed about the periphery thereof, and the signature grippers may be adapted to grip signatures seriatim as they are received from a signature supply means after they have been shifted therefrom to the rotary drum by cam driven suction means or other like components. Conventionally, the suction means will include oscillating suction grippers together with a vacuum control valve.

In the case of saddle stitched books, a signature feeding apparatus will open the pages of a signature so that it may be dropped onto a saddle conveyor. The saddle conveyor then conveys that signature to the next signature feeding apparatus which may, in like manner, drop still another signature in straddle relation on top of the previously so distributed signature. In this manner, a book which is comprised of an entire collection of different signatures can be gathered for stitching on the saddle conveyor.

As will be appreciated by those skilled in the art, a book is simply a collection of signatures, regardless of the number of signatures and regardless of the manner in which the book is bound.

In more recent years, the books that are gathered on a binding line have been customized and/or personalized by utilizing a variety of different techniques. Typically, this involves computer control systems whereby different combinations of signature feeding apparatus along a binding line are selectively disabled and enabled in order to customize books according to demographics or the like. As a result, there has been a need to control operation of the various signature feeding apparatus on a binding line in a manner that is entirely satisfactory.

In the past, it will be appreciated that this has sometimes been accomplished in a variety of different ways although almost always in a less than satisfactory manner. In this connection, experience has established that a desirable manner of shifting signatures seriatim from a signature supply hopper to a rotary drum is by means of oscillating suction grippers and, thus, one manner of disabling a signature feeding apparatus has been to shut off the vacuum by mounting an air cylinder on the vacuum valve which moves a sliding member across the vacuum inlet port leading to the oscillating suction grippers. While effective to disable the apparatus, this particular technique allows the oscillating suction grippers to continue impacting the stack of signatures in the supply hopper.

While the delivery of signatures is interrupted, the continual impacting of signatures is known to be detrimental. Specifically, it has been found that, in practice, it is sometimes the case that after a given signature feeding apparatus has been disabled for a period of time, a resumption of the vacuum will not cause the next signature in the signature supply hopper to be delivered to the rotary drum in such a manner that it can be gripped as intended by the signature grippers thereon. If this fails to occur, a signature that is needed for a given book will not be delivered to the saddle conveyor as required.

As a result, the book that was being formed will be defective and must be discarded and reordered. It is, of course, now known how to accomplish this objective as disclosed in various commonly owned patents and patent applications of R.R. Donnelley & Sons Company, but it would be highly desirable to reduce, if not eliminate, the waste that otherwise is known to exist by reason of this problem utilizing conventional disablement techniques. In other words, the binding line could be rendered more efficient by eliminating this known problem area.

The present invention is directed to overcoming one or more of the foregoing problems and achieving one or more of the resulting objectives.

SUMMARY OF THE INVENTION

It is an object of the present invention to provide an improved signature feeding apparatus which eliminates waste while enhancing efficiency. Further, it is an object of the present invention to provide a signature feeding apparatus having an improved manner of selectively disabling the oscillating suction grippers and/or vacuum control valve thereof. In addition, it is an object of the present invention to provide a latch for a cam follower operatively associated with a suction assembly.

Accordingly, the present invention is directed to a cyclically operable signature feeding apparatus including a driven rotary drum having a plurality of signature grippers disposed about the periphery thereof. The signature grippers are adapted to grip signatures seriatim from a signature supply means. The signature feeding apparatus also includes suction means driven by cam means for shifting signatures seriatim from the signature supply means to the rotary drum for gripping by the signature grippers. The suction means includes oscillating suction grippers together with a vacuum control valve therefor. With this arrangement, the cyclically operable signature feeding apparatus will be seen to further utilize an entirely unique cam follower and latching means arrangement as will be described in greater detail hereinafter.

As for the cam follower, it is operatively associated with the suction means to control movement of the oscillating suction grippers and operation of the vacuum control valve, and the latching means serves to latch the cam follower in a position out of the full path of movement of the cam means to selectively disable the oscillating suction grippers and the vacuum control valve.

In a highly preferred embodiment of the invention, the cam means will be understood to include a cam surface which serves to define a high dwell region and a low dwell region both of which are normally disposed in driving engagement with the cam follower. More specifically, the cam follower advantageously includes a transfer arm having a cam follower surface in engagement with the cam surface of the cam means for imparting oscillating movement thereto. As for the latching means, it is preferably adapted to selectively latch the transfer arm to disable operation of the grippers and the valve when the high dwell region of the cam surface is in engagement with the cam follower surface of the transfer arm. Still additionally, the latching means is thereafter preferably adapted to selectively unlatch the transfer arm to enable the grippers and the valve when the high dwell region of the cam surface is in engagement with the cam follower surface of the transfer arm.

Preferably, the transfer arm is biased by a spring normally urging the cam follower surface toward engagement with the cam surface about an axis remote from the cam means. It is also contemplated that the transfer arm may advantageously be operatively associated with the oscillating suction grippers by a first oscillating movement imparting link and to the vacuum control valve by a second oscillating movement imparting link wherein the first link is joined to the transfer arm at a point generally remote from the axis and the second link is joined to the transfer arm at a point generally intermediate the axis and the point where the first link is joined to the transfer arm. With this arrangement, the first link is preferably joined to the transfer arm generally in the region where the cam follower surface is normally in engagement with the cam surface.

In a most highly preferred embodiment, the latching means will be understood to include a latch arm mounted adjacent the end of the transfer arm remote from the axis thereof in such manner as to accommodate pivotal movement from a first unlatched position to a second latched position. The first position of the latch arm allows free movement of the transfer arm whereas the second latched position is such that the latch arm is in engagement with a projection on the transfer arm at a point remote from the axis thereof. Advantageously, the vacuum control valve is always in an off position whenever the transfer arm is in a position where the cam follower surface is in engagement with the high dwell region of the cam surface whether the transfer arm is selectively latched or unlatched.

Other objects, advantages and features of the present invention will become apparent from a consideration of the following specification taken in conjunction with the accompanying drawings.

DETAILED DESCRIPTION OF THE PREFERRED EMBODIMENT

Figure 1:
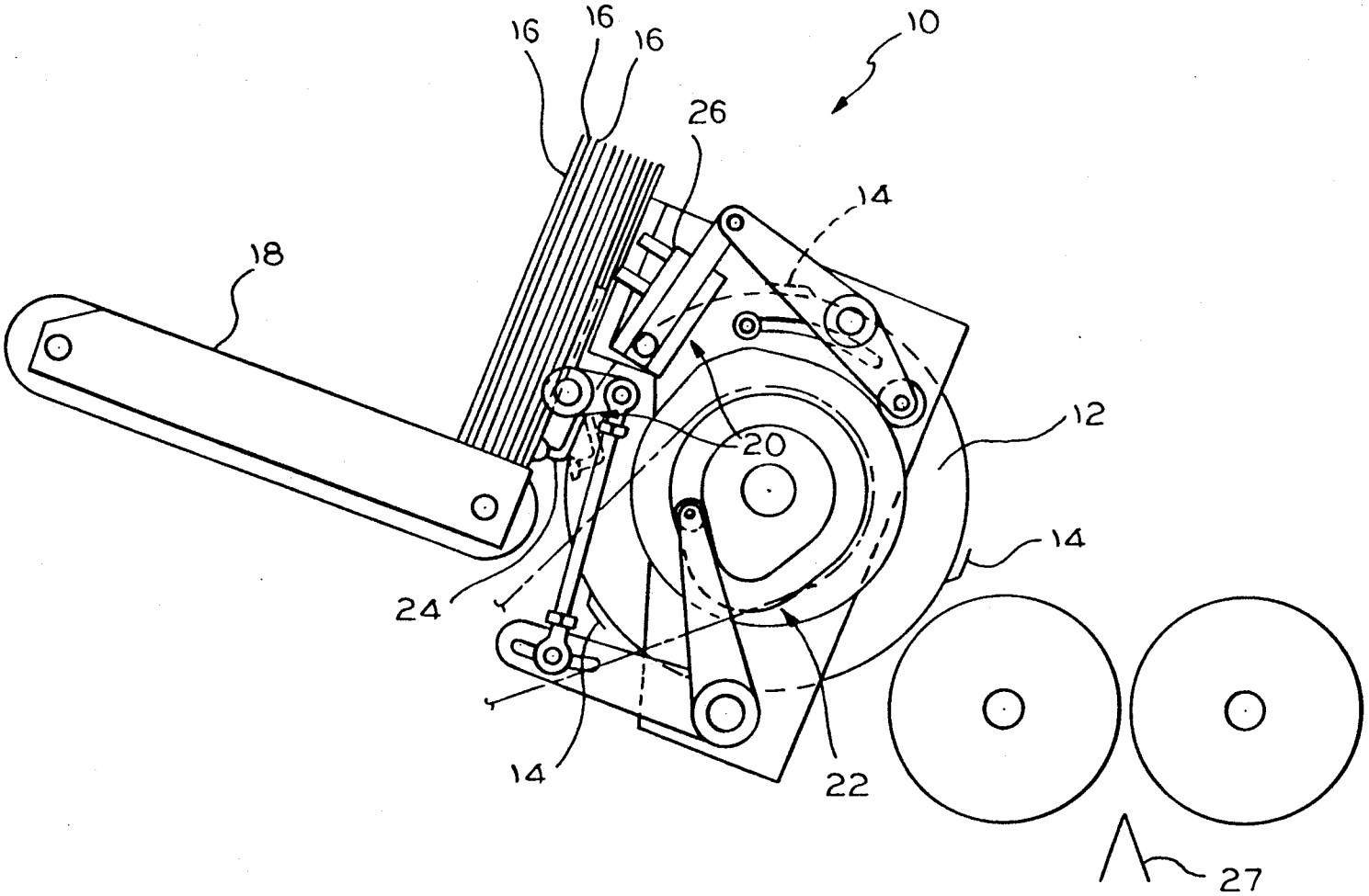
FIG. 1 is a schematic side elevational view of a prior art signature feeding apparatus.

In the illustrations given, and with reference first to FIG. 1, the reference numeral 10 designates generally a cyclically operable signature feeding apparatus including a driven rotary drum 12 having a plurality of signature grippers 14 disposed about the periphery thereof. The signature grippers 14 are adapted to grip signatures 16 seriatim from a signature supply means 18. The signature feeding apparatus 10 also includes suction means generally designated 20 driven by cam means generally designated 22 for shifting signatures 16 seriatim from the signature supply means 18 to the rotary drum 12 for gripping by the signature grippers 14. The suction means 20 includes oscillating suction grippers 24 together with a vacuum control valve 26. With this arrangement, the signature feeding apparatus 10 will be understood as operable to move signatures such as 16 in a cyclical manner from a source to a gathering chain 27.

Figure 2:
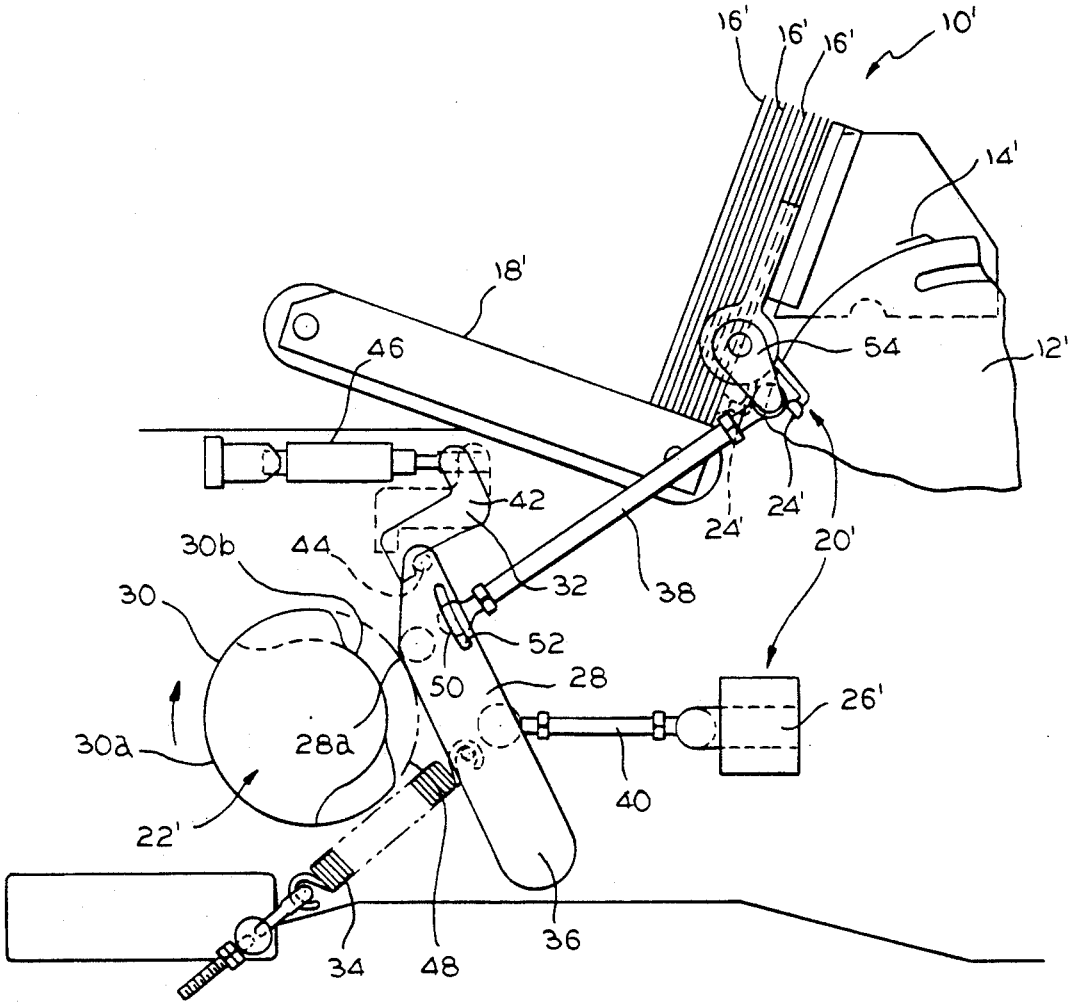
FIG. 2 is a schematic side elevational view of a signature feeding apparatus according to the invention.

With this understanding of the signature feeding apparatus 10 as known in the art, the present invention can be understood by referring to FIG. 2 where it will be seen that the present invention is directed to a cyclically operable signature feeding apparatus generally designated 10.' The signature feeding apparatus 10' includes a driven rotary drum 12' having a plurality of signature grippers such as 14' adapted to grip signatures such as 16' seriatim from a signature supply means 18', and suction means generally designated 20' including oscillating suction grippers 24' together with a vacuum control valve 26' are also provided. As will further be appreciated from FIG. 2, the signature feeding apparatus 10' also includes cam means 22' for driving the suction means 24' to shift signatures 16' seriatim from the signature supply means 18' to the rotary 12' for gripping by the signature grippers 14'.

Still referring to FIG. 2, the signature feeding apparatus 10' includes a cam follower 28 operatively associated with the suction means 20' to control movement of the oscillating suction grippers 24' as well as operation of the vacuum control valve 26'. The cam means 22' includes a cam surface 30 defining a high dwell region **30*a* and a low dwell region 30*b* both of which are normally in driving engagement with the cam follower 28. As will be appreciated, the cam follower 28 comprises a transfer arm having a cam follower surface 28*a* which is normally in engagement with the cam surface 30 of the cam means 22'** for imparting oscillating movement thereto.

As also shown in FIG. 2, the signature feeding apparatus 10' includes means for latching the transfer arm 28 in a position out of the full path of movement of the cam means 22' so as to thereby selectively disable the oscillating suction grippers 24' and the vacuum control valve 26'. The latching means, which includes a latching arm 32, is adapted to selectively latch the transfer arm 28 (as shown in solid lines) to disable operation of the grippers 24' and the valve 26' at a point in time when the high dwell region **30*a* of the cam surface 30 is engagement with the cam follower surface 28*a* of the transfer arm 28. Thereafter, the latch arm 32 is adapted to selectively unlatch the transfer arm 28 to enable the grippers 24' and the valve 26' at a point in time when the high dwell region 30*a* of the cam surface 30 is in engagement with the cam follower surface 28*a* of the transfer arm 28**.

As will be appreciated, the transfer arm 28 is biased by a spring 34 normally urging the cam follower surface **28*a* toward engagement with the cam surface 30 about an axis 36 remote from the cam means 22'. It will also be seen that the transfer arm 28 is operatively associated with the oscillating suction grippers 24' by a first oscillating movement imparting link 38 and to the vacuum control valve 26' by a second oscillating movement imparting link 40 wherein the first link 38 is joined to the transfer arm 28 at a point remote from the axis 36 and the second link 40 is joined to the transfer arm 28 at a point generally intermediate the axis 36 and the point where the first link 38 is joined to the transfer arm 28. Still additionally, and as shown in FIG. 2, the first link 38 is joined to the transfer arm 28 generally in the region where the cam follower surface 28*a* is in engagement with the cam surface 30 of the cam means 22'**.

As previously discussed, the latching means includes a latch arm 32 mounted for pivotal movement about an axis 42 adjacent the end of the transfer arm 28 remote from the axis 36 thereof. It will be seen by comparing the two positions of the latch arm 32 illustrated in FIG. 2 that the latch arm 32 is pivotally moveable from a first unlatched position shown in broken lines to a second latched position shown in solid lines in engagement with a projection 44 on the transfer arm 28 at a point remote from the axis 36 thereof. If desired, and as shown, the latch arm 32 may be moved from the unlatched position to the latched position by means such as a hydraulic cylinder generally designated 46 that may be controlled in any conventional fashion.

While not specifically shown, the vacuum control valve 26' is such that it is always in an off position whenever the transfer arm 28 is in a position where the cam follower surface 28*a* is in engagement with the high dwell region 30*a* of the cam surface 30. This holds true whether the transfer arm 28 is selectively latched or unlatched by the latch arm 32 since the latched position coincides with the high dwell position of the cam surface 30 as will be appreciated by referring to the broken line representation at 48. In any case, whenever the transfer arm 28 is in the position illustrated in FIG. 2, where it is shown in its position when latched as well as its position when in engagement with the high dwell region 30*a*, no vacuum is being delivered to the oscillating suction grippers 24'.

Still referring to FIG. 2, the first link 38 will be seen to be mounted to the transfer arm 28 as at 50. It will also be seen that the transfer arm 28 has a slot 52 whereby the mounting as at 50 is adjustable to the extent of the ar defined by the slot 52 to vary the movement of the oscillating suction grippers 24'. At the other end, the first link 38 is joined to the oscillating suction grippers 24' through a crank arm 54.

More specifically, the oscillating suction grippers 24' will typically be mounted on a hollow rod secured to the crank arm 54, and will usually comprise a plurality of individual suckers along the length of the rod which pivot between the positions shown in broken lines and solid lines. In this connection, the oscillating suction grippers 24' will be in contact with the forwardmost of the signatures 16' in the signature supply means 18' when the cam follower surface 28*a* is in contact with the cam surface 30 in the low dwell region 30*b*. With a suction being applied, the forwardmost one of the signatures 16' will then be drawn toward the rotary drum 12' as the cam follower surface 28*a* rides up away from the low dwell region 30*b* toward the high dwell region 30*a*, and the vacuum will be removed when the cam follower surface 28*a* reaches the high dwell region 30*a* of the cam surface 30. At this point, the crank arm 54 will have completed its rocking motion from the signature supply means 18' toward the rotary drum 12' and the signature grippers 14' will grip the signature 16' to carry it by means of the rotary drum 12' to the gathering chain such as 27 (see FIG. 1).

As will now be appreciated, the latch arm 32 simultaneously disables the movement of the oscillation suction grippers 24' as well as the vacuum being applied thereto which serves to ensure that the stack of signatures 16' will not be disrupted by reason of impacting of the oscillation suction grippers 24' thereagainst. In addition, and as will be appreciated by making reference to FIG. 2, the latch arm 32 serves to both latch and unlatch the transfer arm 28 when the cam means 22' is in a high dwell position, i.e., with the cam follower surface 28*a* in engagement with the high dwell region 30*a* of the cam surface 30, as previously discussed.

Due to the significant length of the high dwell region 30*a*, this not only provides more time to activate the latch arm 32 but also causes the transfer arm 28 to be unlatched at a point in time when the cam follower surface 28*a* is in engagement with the high dwell region 30*a* of the cam surface 30 thereby preventing clatter and wear.

While in the foregoing there has been set forth a preferred embodiment of the invention, it will be appreciated that the details herein given may be varied by those skilled in the art without departing from the true spirit and scope of the appended claims.

I claim:

1. In a cyclically operable signature feeding apparatus including a driven rotary drum having a plurality of signature grippers disposed about the periphery thereof, said signature grippers being adapted to grip signatures seriatim from a signature supply means, suction means driven by cam means for shifting signatures seriatim from said signature supply means to said rotary drum for gripping by said signature grippers, said suction means including oscillating suction grippers together with a vacuum control valve, the improvement comprising:

a cam follower operatively associated with said suction means to control movement of said oscillating suction grippers and operation of said vacuum control valve; and means for latching said cam follower in a position out of the full path of movement of said cam means to selectively disable said oscillating suction grippers and said vacuum control valve.

2. The signature feeding apparatus of claim 1 wherein said cam means includes a cam surface defining a high dwell region and a low dwell region both of which are normally in driving engagement with said cam follower, said latching means being adapted to selectively disable said oscillating suction grippers and said vacuum control valve when said high dwell region of said cam surface is in engagement with said cam follower.

3. The signature feeding apparatus of claim 1 wherein said cam follower includes a transfer arm having a cam follower surface in engagement with a cam surface of said cam means for imparting oscillating movement thereto, said transfer arm being biased by a spring normally urging said cam follower surface of said transfer arm toward engagement with said cam surface of said cam means about an axis remote from an axis of said cam means.

4. The signature feeding apparatus of claim 1 wherein said cam follower includes a transfer arm having a cam follower surface in engagement with a cam surface of said cam means for imparting oscillating movement thereto, and said transfer arm being operatively associated with said oscillating suction grippers by a first oscillating movement imparting link and to said vacuum control valve by a second oscillating movement imparting ink.

5. The signature feeding apparatus of claim 1 wherein said cam follower includes a transfer arm having a cam follower surface in engagement with a cam surface of said cam means for imparting oscillating movement thereto, said latching means including a latch arm mounted for pivotal movement between a first position out of the path of movement of said transfer arm and a second position in latched engagement with said transfer arm.

6. In a cyclically operable signature feeding apparatus including a driven rotary drum having a plurality of signature grippers disposed about the periphery thereof, said signature grippers being adapted to grip signatures seriatim from a signature supply means, suction means driven by cam means for shifting signatures seriatim from said signature supply means to said rotary drum for gripping by said signature grippers, said suction means including oscillating suction grippers together with a vacuum control valve, the improvement comprising:

a cam follower operatively associated with said suction means to control movement of said oscillating suction grippers and operation of said vacuum control valve, said cam means including a cam surface defining a high dwell region and a low dwell region both of which are normally in driving engagement with said cam follower, said cam follower including a transfer arm having a cam follower surface in engagement with said cam surface of said cam means for imparting oscillating movement thereto; and means for latching said transfer arm in a position out of the full path of movement of said cam means to selectively disable said oscillating suction grippers and said vacuum control valve.

7. The signature feeding apparatus of claim 6 wherein said latching means is adapted to selectively latch said transfer arm when said high dwell region of said cam surface is in engagement with said transfer arm, said transfer arm being biased by a spring normally urging said cam follower surface of said transfer arm toward engagement with said cam surface of said cam means about an axis remote from an axis of said cam means.

8. The signature feeding apparatus of claim 6 wherein said latching means is adapted to selectively unlatch said transfer arm when said high dwell region of said cam surface is in engagement with said transfer arm, said transfer arm being biased by a spring normally urging said cam follower surface of said transfer arm toward engagement with said cam surface of said cam means about an axis remote from an axis of said cam means.

9. The signature feeding apparatus of claim 6 wherein said transfer arm is operatively associated with said oscillating suction grippers by first link means and to said vacuum control valve by second link means, said latching means including a latch arm mounted for pivotal movement between a first unlatched position out of the path of movement of said transfer arm and a second latched position in latched engagement with said transfer arm.

10. In a cyclically operable signature feeding apparatus including a driven rotary drum having a plurality of signature grippers disposed about the periphery thereof, said signature grippers being adapted to grip signatures seriatim from a signature supply means, suction means driven by cam means for shifting signatures seriatim from said signature supply means to said rotary drum for gripping by said signature grippers, said suction means including oscillating suction grippers together with a vacuum control valve, the improvement comprising:

a cam follower operatively associated with said suction means to control movement of said oscillating suction grippers and operation of said vacuum control valve, said cam means including a cam surface defining a high dwell region and a low dwell region both of which are normally in driving engagement with said cam follower, said cam follower including a transfer arm having a cam follower surface in engagement with said cam surface of said cam means for imparting oscillating movement thereto; and means for latching said transfer arm in a position out of the full path of movement of said cam means so as to thereby selectively disable said oscillating suction grippers and said vacuum control valve, said latching means being adapted to selectively latch said transfer arm to disable operation of said grippers and said valve when said high dwell region of said cam surface is in engagement with said cam follower surface of said transfer arm, said latching means thereafter being adapted to selectively unlatch said transfer arm to enable said grippers and said valve when said high dwell region of said cam surface is in engagement with said cam follower surface of said transfer arm.

11. The signature feeding apparatus of claim 10 wherein said transfer arm is biased by a spring normally urging said cam follower surface toward engagement with said cam surface about an axis remote from said cam means, said transfer arm being operatively associated with said oscillating suction grippers by a first oscillating movement imparting link and to said vacuum control valve by a second oscillating movement imparting link.

12. The signature feeding apparatus of claim 11 wherein said first link is joined to said transfer arm at a point remote from said axis, said first link being joined to said transfer arm generally in the region where said cam follower surface is in engagement with said cam surface, said second link being joined to said transfer arm at a point generally intermediate said axis and the point where said first link is joined to said transfer arm.

13. The signature feeding apparatus of claim 11 wherein said latching means includes a latch arm mounted for pivotal movement adjacent the end of said transfer arm remote from said axis thereof, said latch arm being pivotally movable from a first unlatched position allowing free movement of said transfer arm to a second latched position in engagement with a projection on said transfer arm at a point remote from said axis thereof.

14. The signature feeding apparatus of claim 10 wherein said vacuum control valve is always in an off position whenever said transfer arm is in a position where said cam follower surface is in engagement with said high dwell region of said cam surface whether said transfer arm is selectively latched or unlatched by said latching means whereby no vacuum is being delivered to said oscillating suction grippers.

* * * * *